US006946609B1

(12) United States Patent
Lajoie et al.

(10) Patent No.: US 6,946,609 B1
(45) Date of Patent: Sep. 20, 2005

(54) ALIGNMENT MECHANISM FOR A TELESCOPIC SWITCH

(75) Inventors: Marc André Lajoie, Quebec (CA); Daniel Gaboury, Quebec (CA)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/983,187

(22) Filed: Nov. 8, 2004

(51) Int. Cl.[7] ..... H01H 19/14; H01H 19/00
(52) U.S. Cl. ..... 200/336; 200/48 V
(58) Field of Search ..... 200/336, 48 V, 200/11 R, 19.07, 52 R, 329

(56) References Cited

U.S. PATENT DOCUMENTS 3,153,129 A * 10/1964 Lapidus et al. ..... 200/504
3,247,338 A * 4/1966 Gratzmuller ..... 200/48 R
3,562,465 A * 2/1971 Turgeon ..... 200/501
4,568,808 A * 2/1986 Thuries et al. ..... 200/48 V
4,612,424 A * 9/1986 Clark et al. ..... 200/50.18
4,644,111 A * 2/1987 Hammond ..... 200/8 A
5,326,944 A * 7/1994 Garcia ..... 200/11 R

* cited by examiner

*Primary Examiner*—Richard K. Lee
(74) *Attorney, Agent, or Firm*—Nixon & Vanderhye, P.C./G.E.

(57) ABSTRACT

In a telescopic switch between a step-up transformer and a generator, axially spaced sets of three alignment mechanisms each are disposed in a housing. Each mechanism includes puck secured to an insulator secured in turn to a fixed conductor, an inner ring and a base plate. The puck is threaded into an opening through the inner ring and has an axis of rotation relative to the inner ring opening offset from the axis of rotation of the inner ring relative to the base plate. By screw threading the puck relative to the inner ring, radial adjustment of an attached conductor is provided. By rotating the inner ring, the eccentrically mounted puck carrying the insulator and fixed conductor is rotated about the geometric axis of the opening in which the inner ring rotates for displacing the fixed conductor laterally.

11 Claims, 4 Drawing Sheets

ALIGNMENT MECHANISM FOR A TELESCOPIC SWITCH

BACKGROUND OF THE INVENTION

The present invention relates to an alignment mechanism for a telescopic switch for use for example between a step-up transformer and a generator and particularly relates to alignment mechanisms for the telescopic switch for aligning a circular array of contact fingers of a fixed conductor with a moving conductor.

In land based power generation plants such as nuclear, coal or gas turbine-fired plants, there is typically a connection between a step-up transformer and the generator which includes bus ducts and a telescopic switch. Since there is often variable and substantial distances between the transformer and generator in actual usage at various power plants, e.g., on the order of 100 feet, a bus duct, i.e., a conductor within an enclosure and a telescopic switch are used to connect the transformer and generator. The telescopic switch and bus ducts at opposite ends of the switch must therefore be assembled and fixed to one another in the field to complete the conductive link between the transformer and generator.

A telescopic switch is typically comprised of three circular conductors. Two of the conductors are fixed and a moving conductor is disposed between the fixed conductors. Generally the fixed conductors and a movable conductor are coaxially arranged with the movable conductor intermediate the fixed conductors. Contact fingers are arrayed about near ends of the fixed conductors for contact with the movable conductor. By moving the movable conductor in an axial direction and displacing it inside one of the fixed conductors, the telescopic switch may be moved between open and closed positions. It is singularly important, however, that the circular array of fingers of the fixed conductors all contact the contact area of the movable conductor simultaneously in order to optimize the efficiency of the switch. Thus, field alignment of the fixed and movable conductors is absolutely essential.

In the past, both fixed conductors were supported by two insulators each carried by a housing. The insulators were mounted on a plate and those plates were held in place by four jack screws. This mechanism was composed of a large number of machined parts. When adjustment was required, it was a difficult and long process in order to achieve proper alignment of the conductors due mainly to the complexity of the system. For example, it oftentimes took two to three days to properly adjust and align the conductors relative to one another in the field. Accordingly, there is a need for a field alignment mechanism which would enable adjustment of both fixed conductors relative to the movable conductor to obtain accurate alignment of the rings of contact fingers with the movable conductor just prior to making electrical contact and obtaining the fully closed switch position or conversely when opening the switch.

BRIEF DESCRIPTION OF A PREFERRED ASPECT OF THE INVENTION

In accordance with a preferred aspect of the present invention, there is provided a housing surrounding the movable and fixed conductors and contact fingers and which housing mounts two sets of alignment mechanisms for accurately aligning the conductors. Each alignment mechanism includes a base ring secured to the housing, an inner ring mounted for rotation within an opening in the base ring and an inner puck carried by and eccentrically mounted relative to the geometric axis of rotation of the inner ring about the base plate. The inner puck is screw threaded to the inner ring. The inner puck is also secured to an insulator in turn secured to a fixed conductor. It will therefore be appreciated that the inner puck is mounted for rotation about an axis eccentric to the axis of rotation of the inner ring.

A first set of three alignment mechanisms are secured to the housing at circumferentially spaced positions, preferably 120° apart, for engaging an associated fixed conductor. One of the alignment mechanisms of each set is offset axially from the remaining pair of alignment mechanisms. By threading the inner puck relative to the inner ring, the insulator and hence conductor fixed to the insulator may be displaced radially inwardly and outwardly. By rotating the inner ring relative to the base plate, the eccentric axis of the inner puck rotates about the geometric axis of the inner ring about the base plate, consequently causing the associated fixed conductor to be displaced laterally. By variously moving the puck and inner ring of the mechanisms, the conductors can be shifted radially and laterally such that the contact fingers of each fixed conductor are equally spaced from the movable conductor enabling simultaneous engagement and disengagement of the contact fingers relative to the movable conductor upon actuation of the switch.

In a preferred embodiment of the present invention having a telescopic switch with a fixed cylindrical conductor and a movable cylindrical conductor in substantial axial alignment with one another, there is provided alignment apparatus for aligning electrical contact between the movable conductor and the fixed conductor comprising: a housing about the conductors; an alignment assembly between the housing and the fixed conductor including (i) a base plate carried by the housing having a first cylindrical opening about a first geometric axis, (ii) a cylindrical inner ring having a second cylindrical opening about a second geometric axis and an outer cylindrical surface about a third axis, the second axis being offset from the third geometric axis and (iii) a cylindrical inner puck threadedly engaging the second cylindrical opening of the inner ring and having a fourth geometric axis coincident with the second geometric axis; and an insulator connected between the puck and the one fixed conductor enabling radial movement of the one conductor relative to the housing in response to threading the puck relative to the inner ring and lateral movement of the conductor in response to rotation of the inner ring and the puck relative to the base plate about the first axis.

In a further preferred embodiment of the present invention having a telescopic switch with first and second fixed cylindrical conductors and a movable cylindrical conductor intermediate the pair of conductors, the conductors being in substantial axial alignment with one another, there is provided alignment apparatus for aligning electrical contacts between the movable conductor and the fixed conductors comprising: a housing about the conductors; a set of at least three alignment assemblies between the housing and each the fixed conductor at axially spaced locations along the switch, each the alignment assembly including (i) a base plate carried by the housing having a first cylindrical opening about a first geometric axis, (ii) a cylindrical inner ring having a second cylindrical opening about a second geometric axis and an outer cylindrical surface about a third axis, the second axis being offset from the third geometric axis, and (iii) a cylindrical inner puck threadedly engaging the second cylindrical opening of the inner ring and having a fourth geometric axis coincident with the second geometric axis; and insulators connected between the pucks of the first and second sets of assemblies and the first and second fixed conductors, respectively enabling radial movement of the fixed conductors relative to the housing in response to threading the pucks relative to respective inner rings and lateral movement of the fixed conductors in response to rotation of the inner rings and the pucks relative to the base plates about the first axes.

DETAILED DESCRIPTION OF THE INVENTION

Figure 1:
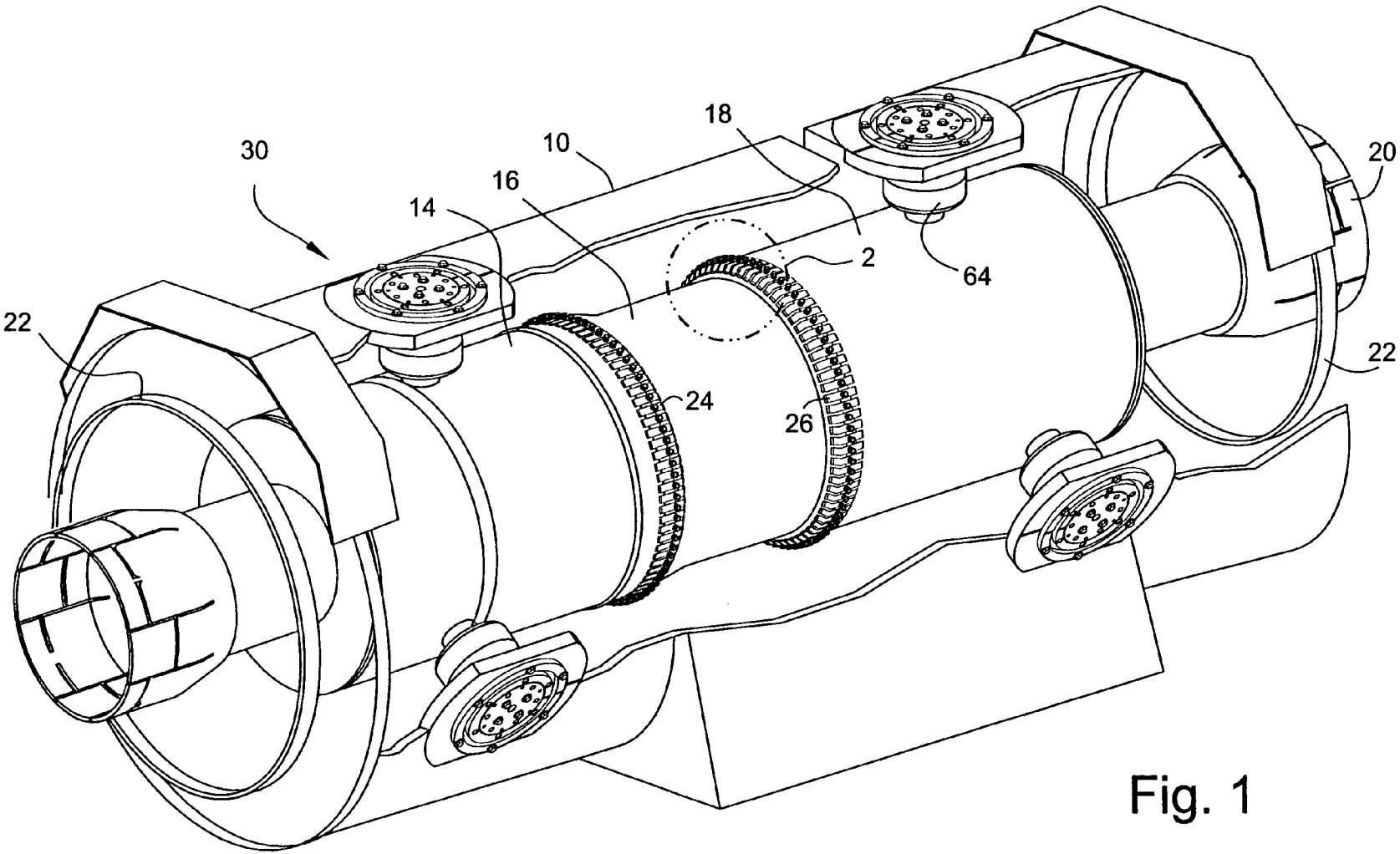
FIG. 1 is a perspective view with parts broken out for clarity of a telescopic switch and alignment mechanisms therefor in accordance with a preferred aspect of the present invention.

Referring now to FIG. 1, there is illustrated an outer housing 10 for a telescopic switch generally designated 12. The telescopic switch 12 includes a first fixed conductor 14, a movable conductor 16 and a second fixed conductor 18. The first fixed conductor 14 and movable conductor 16 are accurately aligned relative to one another and provided with a conventional mechanism, not shown, for displacing the movable conductor 16 axially relative to the fixed conductor 14. The mechanism for moving the conductor 16 typically may include, for example, a ball and screw arrangement. Opposite ends of the telescopic switch 12 include laminations 20 which provide the electrical connection to the adjoining parts, for example the step-up transformer and the generator. The electrical connections at opposite ends extend through bus ducts, not shown, secured to the housing 10 about the peripheries 22 at opposite ends.

Figure 2:
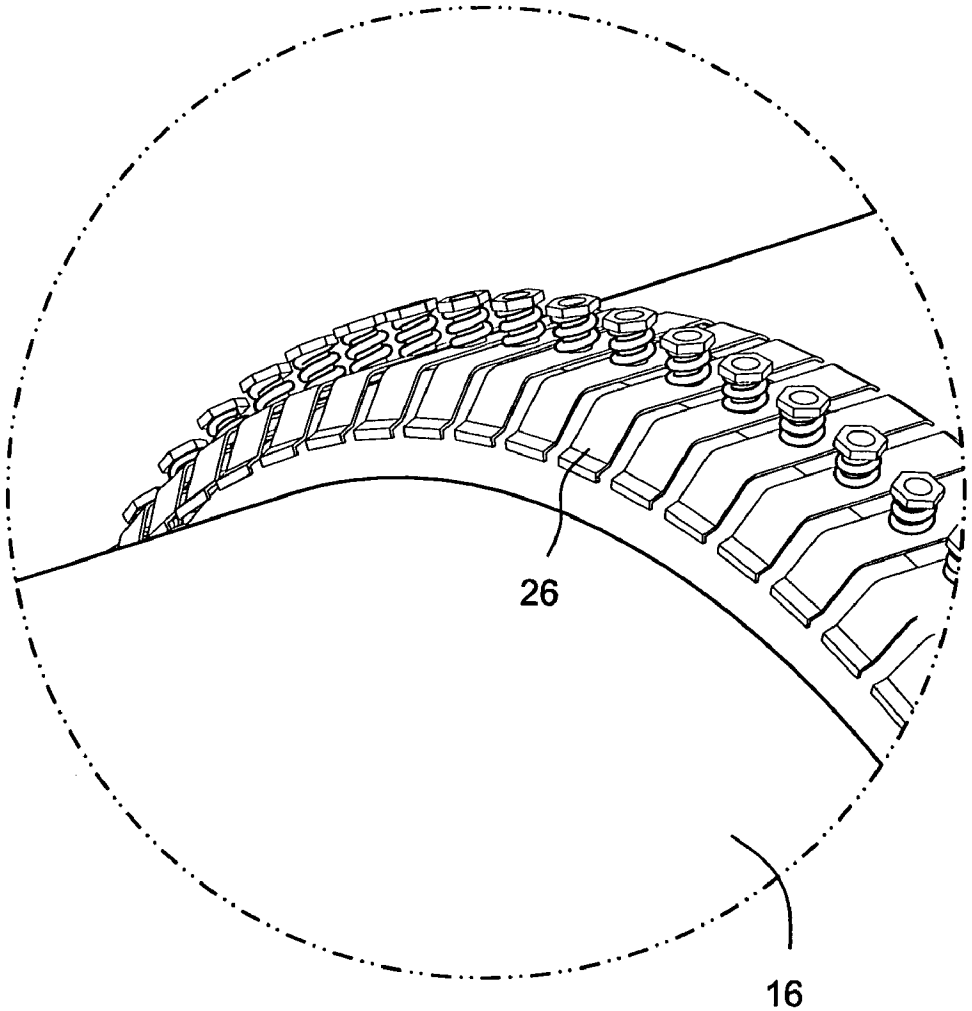
FIG. 2 is an enlarged perspective view taken at circle 2 in FIG. 1 illustrating the contact fingers on one of the fixed conductors in relation to the movable conductor.

Each of the fixed conductors 14 and 18 includes a plurality of circumferentially spaced spring biased contact fingers 24 and 26 respectively. See for example, FIG. 2. These fingers must be accurately aligned with the movable conductor 16 prior to contact with the conductive portion of the movable conductor. That is, alignment mechanisms or assemblies must enable adjustment of one or both of the fixed conductors to obtain perfect alignment with the movable conductor and the rings of contact fingers just before those contact fingers engage with the conductive portions of the movable conductor.

Referring back to FIG. 1, the alignment mechanisms, generally designated 30, are preferably provided in two sets of three alignment mechanisms each. One set of three alignment mechanisms 30 is disposed adjacent one end of the telescopic switch 12 in engagement with one of the fixed conductors, e.g., conductor 14 while the other set of alignment mechanisms 30 lies at the opposite end of the telescopic switch in engagement with the other fixed conductor 18. The mechanisms 30 are preferably equally circumferentially spaced one from the other about the axis of the switch and preferably the three mechanisms per set are located 120° apart. Additionally, one of the mechanisms 30 in each set thereof is axially offset from the remaining two mechanisms of each set. For example, as illustrated in FIG. 1, the uppermost mechanisms 30 in that drawing figure are axially offset toward one another and from the remaining two mechanisms of the associated set.

Figure 3:
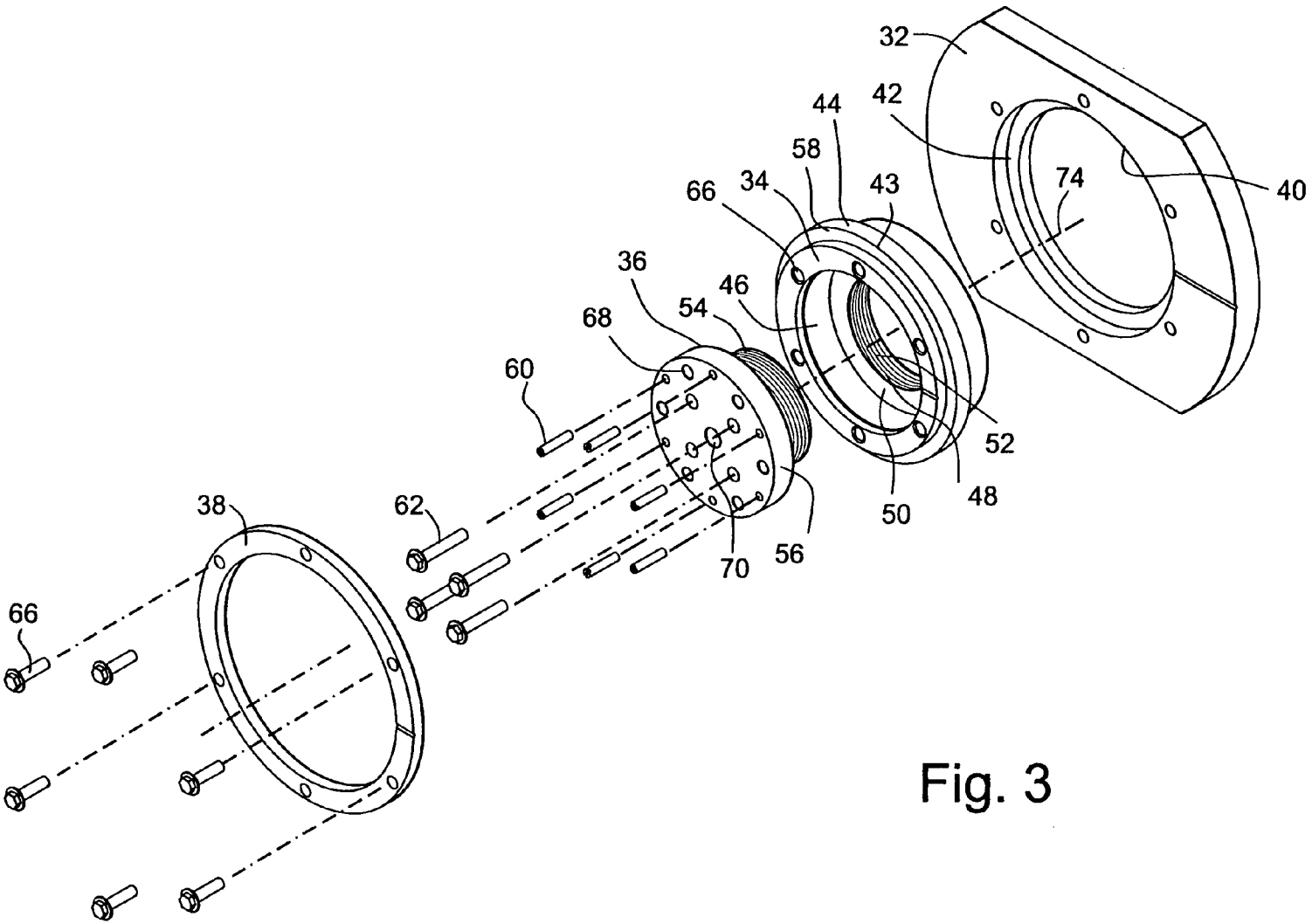
FIG. 3 is an exploded perspective view illustrating an alignment mechanism hereof.

Referring now to FIG. 3, each alignment mechanism includes a base plate 32, an inner ring 34, an inner puck 36 and an outer clamp ring 38. The base plate 32 is secured, for example, by welding to the housing 10 and has an opening 40 in registration with a corresponding opening through the housing 10. The opening 10 includes an annular shoulder 42. Inner ring 34 includes an outer cylindrical surface 43 having a radially outwardly projecting annular flange 44 for seating on the shoulder 42 of base plate 32. Inner ring 34 also includes a stepped inner opening 46 including a radially inwardly directed hub 48 defining an axially facing shoulder 50. The hub 48 has internal female threads 52.

The inner puck 36 includes a reduced diameter male threaded portion 54 and an outer radially projecting flange 56. The inner puck is screw threaded within the inner ring and includes an external surface which lies flush with the external axial face of the inner ring when fully screw threaded. Finally, the clamp ring 38 includes a central opening enabling the clamp ring to bear against the shoulder 58 formed on the inner ring in final assembly of the mechanism 30.

Referring to FIG. 3, and in final assembly, the inner ring flange 44 seats on the shoulder 42 of base plate 32 and is rotatable relative to the base plate when adjustments are being made. The inner puck 36 is screw threaded into the annular inner ring 34. A plurality of set screws 60 are screw threaded into the inner puck and engage the shoulder 50 of the inner ring to fix the inner puck in an adjusted rotational position and against rotation relative to the inner ring 34. Bolts 62, four bolts being illustrated, pass through corresponding openings in the inner puck 36 and secure an insulator 64 (FIG. 1) to the inner puck. Additional bolts 66 are provided for clamping the ring 38 to the base plate 32 with the inner ring and inner puck secured in the opening 40 of base plate 32. For reasons discussed below, each of the inner ring 34 and the inner puck 36 have tool positioning openings 66 and 68, respectively, opening through their axial faces. Finally, the inner puck 36 includes a central opening 70 for receiving a lug on a positioning tool.

Figure 4:
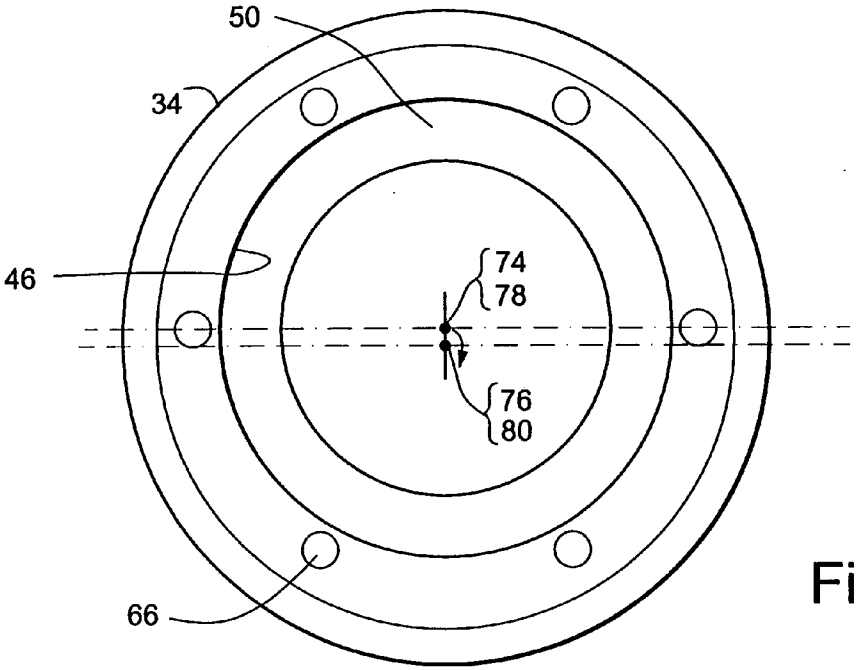
FIG. 4 is an end elevational view of the inner ring illustrating the eccentricity of the inner puck relative to the geometric axis of rotation of the inner ring.

Referring now to FIG. 4, it will be appreciated that the opening 40 through base plate 32 has a first geometric axis 74. The cylindrical opening 46 through the inner ring 34 has a second geometric axis 76. The inner ring 34 has an outer cylindrical surface 43 about a third geometric axis 78 coincident with the geometric axis 74 of the base plate opening 40. The second geometrical axis 76 of the inner ring opening 46 34 is therefore offset from the geometrical axis 78 of the inner ring 34 about its outer cylindrical surface 43. The inner cylindrical puck 36 threadedly engaging the cylindrical opening of the inner ring 34 has a fourth geometric axis 80 coincident with the second geometric axis 76. Thus, the inner puck is eccentrically mounted relative to the opening 40 in the base plate and the geometric axis 78 of rotation of the inner ring.

With this arrangement, it will be appreciated from a review of FIG. 4 that rotation of the inner ring 34 relative to the base plate 32 causes eccentric rotation of the inner puck 36 about coincident axes 74, 78. That is the geometric axis 80 of the puck rotates about the geometric axis 78. Rotation of the inner puck relative to the inner ring is about coincident axes 76 and 80. The eccentricity of the inner puck relative to the inner ring and the threaded configuration of the inner ring and puck enable a lateral displacement of the insulator 64 and hence the associated fixed conductor 14 or 16 and a radial in or out movement of the insulator 64 secured to the puck 36.

In use, the conductors are received in the housing 10. The inner puck of each mechanism 30 is screw threaded into the inner ring and the insulator 64 is attached to the interior face of the puck 36 by bolts 62. These sub-assemblies are inserted through the openings in the housing. The clamp rings 38 are then applied to maintain the sub-assemblies together and within the housing. The inner end of each insulator is then bolted from the inside of the conductor along a central axis of the insulator to secure the alignment mechanism to the conductor.

Figure 5:
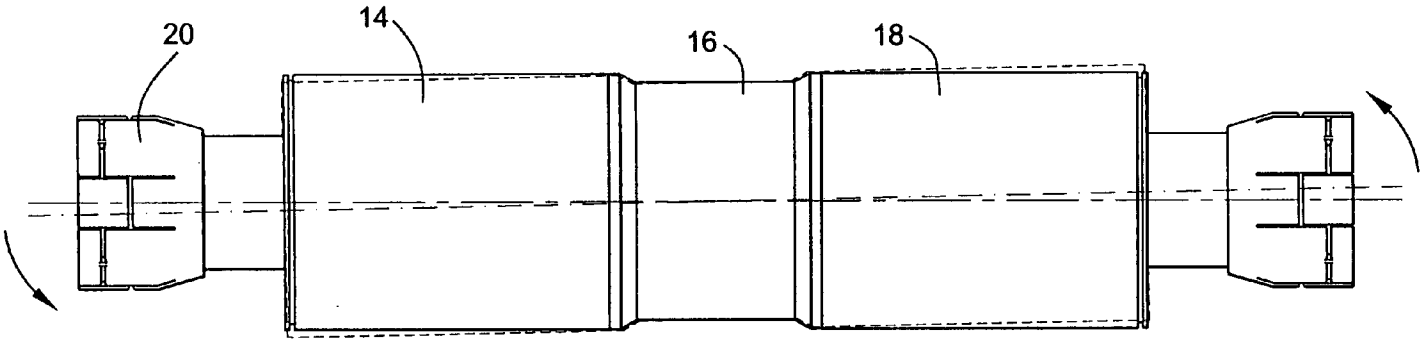
FIG. 5 is a schematic illustration of the telescopic switch and the motion thereof induced by adjustment of the alignment mechanisms.

To center the conductors in the housing, the set screws 60 are backed off. A tool, not shown, has lugs for insertion into tool positioning center opening 70 and one of openings 68. By rotating the tool about the center opening 70, the puck 34 is screw threaded relative to the inner ring 32. By variously adjusting the inner pucks of the different mechanisms relative to their associated inner rings, radial inward and outward movement of the fixed conductors is achieved. To tilt the conductors about their axes as illustrated in FIG. 5, the set screws 60 are backed off from the puck 36. The screws 66 securing the clamp ring 38 to the base plate are also backed off. To tilt or displace the fixed conductors in a lateral direction, a similar or the same tool is employed engaging lugs in the center tool positioning opening 70 and one of the tool positioning openings 66. By rotating the tool about center opening 70, the inner ring 34 of one or more of the various mechanisms is rotated relative to the base plate 32. Since the axis of rotation of the puck 36 relative to the inner ring 32 is offset from the geometric axis of rotation of the inner ring about the base plate opening 40, the rotation of the inner ring 32 will cause a lateral displacement of the insulator 64 in turn causing a re-orientation of the conductor. By variously adjusting the alignment mechanisms, the conductors are centered in the enclosure and aligned coaxially with one another such that the contact fingers 24 and 26 will engage the movable conductor 16 simultaneously. The adjustments proceed concurrently with the use of feeler gages, not shown, to measure the gaps between the contact fingers and the conductor portion of he movable conductor 16 typically measured at 90° intervals about the circumference of the fingers and movable conductor.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. For a telescopic switch having a fixed cylindrical conductor and a movable cylindrical conductor in substantial axial alignment with one another, alignment apparatus for aligning electrical contact between the movable conductor and the fixed conductor comprising:

a housing about the conductors;

an alignment assembly between said housing and said fixed conductor including (i) a base plate carried by said housing having a first cylindrical opening about a first geometric axis, (ii) a cylindrical inner ring having a second cylindrical opening about a second geometric axis and an outer cylindrical surface about a geometrical third axis, said second axis being offset from said third geometric axis and (iii) a cylindrical puck threadedly engaging said inner ring in said second cylindrical opening of said inner ring and having a fourth geometric axis coincident with said second geometric axis; and an insulator connected between said puck and said one fixed conductor enabling radial movement of said one conductor relative to said housing in response to threading said puck relative to said inner ring and lateral movement of said conductor in response to rotation of said inner ring and said puck relative to said base plate about said first axis.

2. Apparatus according to claim 1 wherein said inner ring includes a plurality of tool positioning holes opening through a face thereof for rotating said inner ring relative to said base plate about said first geometric axis.

3. Apparatus according to claim 1 wherein said inner puck includes a plurality of tool positioning holes opening through a face thereof for rotating said puck relative to said inner ring and about said second geometric axis.

4. Apparatus according to claim 1 wherein said puck and said insulator are fixed to one another.

5. For a telescopic switch having first and second fixed cylindrical conductors and a movable cylindrical conductor intermediate said pair of conductors, the conductors being in substantial axial alignment with one another, alignment apparatus for aligning electrical contacts between the movable conductor and the fixed conductors comprising:

a housing about the conductors;

a set of at least three alignment assemblies between said housing and each said fixed conductor at axially spaced locations along said switch, each said alignment assembly including (i) a base plate carried by said housing having a first cylindrical opening about a first geometric axis, (ii) a cylindrical inner ring having a second cylindrical opening about a second geometric axis and an outer cylindrical surface about a geometrical third axis, said second axis being offset from said third geometric axis, and (iii) a cylindrical puck threadedly engaging said inner ring in said second cylindrical opening of said inner ring and having a fourth geometric axis coincident with said second geometric axis; and insulators connected between said pucks of said first and second sets of assemblies and the first and second fixed conductors, respectively enabling radial movement of said fixed conductors relative to said housing in response to threading said pucks relative to respective inner rings and lateral movement of said fixed conductors in response to rotation of said inner rings and said pucks relative to said base plates about said first axes.

6. Apparatus according to claim 5 wherein said inner ring of each said assembly includes a plurality of tool positioning holes opening through a face thereof for rotating said inner ring relative to said base plate about said first geometric axis.

7. Apparatus according to claim 5 wherein said inner puck of each said assembly includes a plurality of tool positioning holes opening through a face thereof for rotating said puck relative to said inner ring and about said second geometric axis.

8. Apparatus according to claim 5 wherein said puck and said insulator of each said assembly are fixed to one another.

9. Apparatus according to claim 5 wherein said assemblies of each set thereof are spaced at substantially equal circumferential distances from one another about said housing.

10. Apparatus according to claim 5 wherein a first assembly of each said set of assemblies is axially spaced from a plane normal to the axis of the switch.

11. Apparatus according to claim 10 wherein said first assemblies of each said set thereof are spaced axially closer to one another that the remaining two assemblies of said set thereof.

* * * * *

UNITED STATES PATENT AND TRADEMARK OFFICE

CERTIFICATE OF CORRECTION

PATENT NO. : 6,946,609 B1
DATED : September 20, 2005
INVENTOR(S) : Lajoie et al.

It is certified that error appears in the above-identified patent and that said Letters Patent is hereby corrected as shown below:

Column 6,
Line 64, replace “that” with -- than --.

Signed and Sealed this

Third Day of January, 2006

JON W. DUDAS
*Director of the United States Patent and Trademark Office*